US006910785B2

(12) United States Patent
Sales

(10) Patent No.: US 6,910,785 B2
(45) Date of Patent: Jun. 28, 2005

(54) INDUSTRIAL LUMINAIRE WITH PRISMATIC REFRACTOR

(75) Inventor: Kenneth Sales, Lawrenceville, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/349,299

(22) Filed: Jan. 22, 2003

(65) Prior Publication Data

US 2004/0141324 A1 Jul. 22, 2004

(51) Int. Cl.[7] ..... F21V 5/02

(52) U.S. Cl. ..... 362/333; 362/308; 362/334; 362/339

(58) Field of Search ..... 362/333, 308, 362/309, 326, 327, 331, 334, 338–340; 445/22; 29/592, 412, 611; 700/98

(56) References Cited

U.S. PATENT DOCUMENTS

| | | | | |
|---|---|---|---|---|
| 3,766,375 | A | | 10/1973 | Edman et al. |
| 3,873,191 | A | * | 3/1975 | Veret et al. ..... 359/869 |
| 4,175,661 | A | | 11/1979 | Barnes |
| 4,403,277 | A | | 9/1983 | Eargle, Jr. et al. |
| 4,683,525 | A | | 7/1987 | Camm |
| 4,839,781 | A | * | 6/1989 | Barnes et al. ..... 362/299 |
| 4,903,180 | A | | 2/1990 | Taylor et al. |
| 5,046,818 | A | | 9/1991 | Barnes |
| 5,143,446 | A | | 9/1992 | Barnes et al. |
| 5,416,684 | A | | 5/1995 | Pearce |
| 5,434,765 | A | * | 7/1995 | Kelly et al. ..... 362/271 |
| 5,444,606 | A | | 8/1995 | Barnes et al. |
| 5,481,445 | A | | 1/1996 | Sitzema et al. |
| D367,337 | S | | 2/1996 | Barnes et al. |
| 5,523,931 | A | | 6/1996 | Kassay et al. |
| 5,528,473 | A | | 6/1996 | Kassay et al. |
| 5,582,479 | A | | 12/1996 | Thomas et al. |
| D384,770 | S | | 10/1997 | Bray |
| D388,526 | S | | 12/1997 | Bray |
| D389,949 | S | | 1/1998 | Walker |
| 5,743,634 | A | | 4/1998 | Sitzema et al. |
| 5,967,648 | A | | 10/1999 | Barnes, II et al. |
| 5,971,569 | A | * | 10/1999 | Smith et al. ..... 362/304 |
| 6,068,388 | A | | 5/2000 | Walker et al. |
| 6,478,454 | B1 | | 11/2002 | Jaffari et al. |

OTHER PUBLICATIONS

Lexalite International Corporation, New Products 2002, web page print out, as of Dec. 23, 2002, 2 pages.*
Lexalite International Corporation, crystal™ Reflexor® product pamphlet, Oct., 2001, 2 pages.*
Lexalite International Corporation, crystal™ Reflexor® product pamphlet, Oct., 2001, 2 pages.*
Lexalite International Corporation, Products and Assembly Services, web page print out, as of Dec. 23, 2002, 1 page.*
Lexalite International Corporation, Prismatic Reflexor® pamphlet, May, 1998, 2 pages.*
Lexalite International Corporation, Prismatic Reflexors® Products and Assembly Services, LexaLite Model 822 Drawings, web page print out, as of Dec. 23, 2002, 1 page.*

(Continued)

*Primary Examiner*—Sandra O'Shea
*Assistant Examiner*—Mark Tsidulko
(74) *Attorney, Agent, or Firm*—Thomas, Kayden, Horstemeyer & Risley

(57) ABSTRACT

An industrial luminaire with a prismatic refractor including an interior surface formed as an open-ended surface of revolution of a plane curve about a rotational axis, the plane curve having a plurality of segments corresponding to segments on a reference curve which, for each segment of the reference curve, the corresponding segment on the plane curve has been incrementally rotated with respect to a reference point on a reference axis for the reference curve.

25 Claims, 16 Drawing Sheets

OTHER PUBLICATIONS

Lexalite International Corporation, Prismatic Reflexors® Products and Assembly Services, LexaLite Model 822 Photometrics, web page print out, as of Dec. 23, 2002, 1 page.*

Lexalite International Corporation, Prismatic Reflexors® Products and Assembly Services, LexaLite Model 822 Prismatic Reflexor, web page print out, as of Dec. 23, 2002, 1 page.*

Lexalite International Corporation, Interface™ Reflexor® Products and Assembly Services, Model 822, web page print out, as of Dec. 23, 2002, 1 page.*

Lexalite International Corporation, LexaLite Product Line, LexaLite's Acrylic and Polycarbonate Lighting Components, web page print out, as of Dec. 23, 2002, 2 pages.*

Lexalite International Corporation, LexaLite Lex–Efx® Light Control Film®, web page print out, as of Dec. 23, 2002, 2 pages.*

Wolfram Research, Eric Weisstein's World of Mathematics, Surface of Revolution, web page print out, as of Dec. 2, 2002, 14 pages.*

Cooper Lighting Lumark® SS16, 22 & 25 Prismatic High–Bay Industrial Luminaire, pamphlet, not dated, 2 pages.*

Cooper Lighting Lumark® HB16, 22 & 25 Prismatic Benchmark, pamphlet, not dated, 2 pages.*

Cooper Lighting Lumark® HB16, 22 & 25 Prismatic Benchmark pamphlet, ( p. 1 of 2, p. 506); and Lumark® SS16, 22 & 25 Prismatic High–Bay Industrial Luminaire, (p. 2 of 2, p. 493) (attached pages), not dated.*

* cited by examiner

INDUSTRIAL LUMINAIRE WITH PRISMATIC REFRACTOR

CROSS-REFERENCE TO RELATED APPLICATIONS

The present application is related to co-pending U.S. Design patent application Ser. No. TBD ("Prismatic Refractor With Circumferential Prisms"), filed on Jan. 22, 2003, and co-pending U.S. Design patent application Ser. No. TBD ("Prismatic Refractor with Circumferential Prisms and Lens), filed on Jan. 22, 2003, which are both incorporated by reference here in their entirety.

TECHNICAL FIELD

The subject matter disclosed here generally relates to illumination, and, more particularly, to a light source support and modifier including a refractor.

BACKGROUND

The "INESA Lighting Handbook," ninth edition, published by the Illuminating Engineering Society of North America, is incorporated by reference here in its entirety. As discussed in chapter seven of that book, a "luminaire" is a device for producing, controlling, and distributing light. It is typically a complete lighting unit consisting of one or more lamps, sockets for positioning and protecting the lamps and for connecting the lamps to a supply of electric power, optical devices for distributing the light, and mechanical components for supporting or attaching the luminaire. Luminaires are also sometimes referred to as "light fixtures."

Luminaires are usually classified by their application, such as residential, commercial, or industrial. However, a particular luminaire can often be used in more than one application, depending upon its performance characteristics. For example, so-called "high bay" and "low bay" luminaires are often used for general lighting in industrial and other settings. Low bay luminaires are generally designed to provide adequate vertical illumination for spaces with mounting heights that are less than about 20 feet. High bay luminaires, on the other hand, are generally used in applications with mounting heights that are greater than 20 feet. However, high bay luminaires can also be used at lower mounting heights to produce light distributions that vary from narrow to wide, depending on the application and the need for vertical illumination.

For high bay, low bay, and other luminaires, the light distribution is often controlled using a "refractor." Refractors are light control devices that take advantage of the change in direction that light undergoes as it passes through the boundary of materials having different optical densities (or indices of refraction), such as air to glass or air to plastic. This redirecting is typically accomplished with two-or three-dimensional prisms that are raised from, or embossed into, the surface of a translucent material, such as acrylic plastic, polycarbonate, or glass. When the prisms are formed on the surface of a substantially flat sheet of material, then the sheet is sometimes referred to as a "prismatic lens."

The material that is used in a refractor may also have reflective characteristics, such as those that produce a phenomenon known as "total internal reflection." In this phenomenon, light passes through the first surface of the refractive material and is mostly reflected from the second surface, back into the material, and out the first surface. Due to this and other reflective properties of many light-transmitting materials, the term "reflector" is sometimes loosely interchanged with the term "refractor" in connection with light distribution devices in luminaires.

Luminaire performance is typically described in terms of a combination of electrical, photometric, mechanical, thermal, and/or other characteristics. Photometric performance refers to the efficiency and effectiveness with which a luminaire delivers light to an intended target. The mechanical performance of a luminaire refers to its behavior under environmental extremes such as water spray, moisture, or dust, while thermal performance describes the behavior of the luminaire at elevated temperatures.

Photometric performance is often described in terms of various light distribution characteristics of a luminaire. For example, a "luminous intensity distribution curve" may be used to represent the variation of luminous intensity in a plane through the light center of the luminaire. (The light center is the center of the smallest sphere that would completely contain the light-omitting element of the lamp, often simply the center of the arc tube.) Indoor luminaires are typically described in terms of a vertical intensity distribution curve that is obtained by taking measurements at various angles of elevation about a source in a vertical plane through the light center. Unless otherwise specified, the vertical distribution curve is assumed to represent an average such as would be obtained by rotating the luminaire about its vertical axis where the origin, or "nadir," is downward through the light center.

Luminous intensity values are typically recorded at various vertical elevations between 0° to 90° or 180°. The total number of lumens emitted by the luminaire can then be calculated from the luminous intensity distribution. Dividing this total number of lumens produced by the luminaire by the number of lumens that are omitted by the lamp then provides the overall efficiency of the luminaire. Luminous intensity can also be determined for nested, solid angle, cones having apexes at the luminaire photometric center. Each cone then defines a conic zone and the lumens within each zone are referred to as "zonal lumens." This zonal lumen data is often presented for each zone as a percentage of the total lumens produced by the fixture ("% Fixture" or "% F") and/or a percentage of the total lumens produced by the lamp, without the fixture ("% Lamp" or "% L").

Photometric performance can also be described in terms of a luminaire spacing criterion, or "SC." The SC of a luminaire is an estimated maximum ratio of spacing to mounting height above the work plane for a regular array of luminaires such that the work plane illumination will be acceptably uniform. SC is often loosely used interchangeably with spacing-to-mounting-height ratio, or "SMH" which is now a disfavored term. For luminaires with an adjustable SC, it is generally preferred that the beam width be adjustable over as broad a range as possible.

The mechanical and thermal performance characteristics of a luminaire can also be described in a variety of ways. For example, as noted above, certain applications require luminaires which are resistant to liquid and/or vapor infiltration. With regard to thermal performance, the effect of lamp heat on the luminaire materials can also be quite important because various refractor materials exhibit poor heat resistance above certain temperatures.

For example, although acrylic refractors can be formed using a wide variety of common manufacturing techniques, they generally have poor resistance to heat when used in lighting applications at temperatures above 90° C. Consequently, the maximum lamp wattage for a particular luminaire will often be limited by the temperature at which the acrylic refractor starts to discolor. Although so-called "high heat acrylics" or polycarbonate materials can sometimes be used to allow for higher-wattage lamps, they are generally more-expensive and can only withstand about an additional 20–50° C. increase in continuous operating temperature.

Cooper Lighting of Peachtree City, Ga. offers a wide variety of industrial luminaires under its LUMARK® brand. For example, Cooper's SS series of prismatic high-bay products and FP series of prismatic food processing luminaires are provided with acrylic prismatic refractors and have multiple field-adjustable lamp positions for providing various light-distribution patterns. The beam dispersion of these luminaires can be increased, or decreased, by positioning the lamp closer, or further, from the opening of the refractor. Cooper Lighting's SS, FP and HB Series of products are optionally provided with a prismatic drop lens for covering the opening of the refractor. Cooper Lighting and/or its parent, Cooper Industries, Inc. also own a variety of patents covering various aspects of industrial lighting including U.S. Pat. No. 4,403,277 which is incorporated by reference here in its entirety.

LexaLite International Corporation of Charlevoix, Mich. offers a line of acrylic and polycarbonate refractors that it refers to as its "800 Series Prismatic Reflexor®." For example, information about LexaLite's Model 822 is available at www.lexalite.com/822.html, including images, zonal lumen, and other data. Conical lenses and drop lenses are also available for Lexalite's Model 822. These and other of LexaLite products are allegedly covered by U.S. Pat. Nos. 4,839,781, 5,446,606, and D367,337, each of which is also incorporated by reference here in its entirety.

U.S. Pat. No. 4,839,781 to Barnes et al. discloses a reflector/refractor device that is generally shaped as an inverted bowl. The body of the device is defined by a series of sectional zones that are formed as frustro-toroidal segments. The outside surface of the body is formed with a plurality of reflective/refractive prism elements that consist of curved and angled surfaces. Internal rays impinging on these surfaces will be reflected or refracted as the incident angle is greater than or less than the critical angle of the transparent material forming the body.

Each of the Barnes et al. zones has a predetermined radius with an origin that is offset from the vertical axis in order to create the bowl-shaped profile of the body. The light distribution characteristics for the top and bottom zones are selectively variable by vertical movement of the light source so as to increase or decrease the incident angle to the inner surface of the body. This, in turn, increases or decreases the internal incident angle to the corresponding prism element with respect to the critical angle of the material so as to reflect or transmit, through refraction, individual rays.

U.S. Pat. No. 5,444,606, also to Barnes et al., discloses a combination of a prismatic reflector and a prismatic lens for use with lighting fixtures. The reflector body has a substantially parabolic contour defining an interior cavity and includes a plurality of prisms for receiving, transmitting, and reflecting light. An inside surface of the reflector includes a smooth light-receiving, lower surface portion and an optional light depressing prism portion. The prisms provide modest or slight light spreading for additional rays near nadir. Rays which are omitted from the lamp to near the top, middle, and bottom of the reflector are illustrated as striking the surface at near normal angles in order to reduce first surface reflections and refraction losses.

U.S. Pat. No. 4,903,180 to Taylor et al. (assigned at issuance to General Electric Company) is also incorporated by reference here and discloses a luminaire with a protected prismatic reflector. The dome-shaped reflector includes a series of superimposed integrally-connected sections, each of a truncated conical form that tapers to a progressively greater extent than the one beneath it. This patent also notes that a substantial amount of light will pass through the reflector even though the reflecting surfaces of the prisms are clean. According to the patent, one reason for this effect is that the molds used for making such reflectors are not precise enough to achieve mathematical precision of the reflecting surfaces all the way to the apexes of the prisms and to the nadir of the valleys between them. Additional light leakage can also occur at points of defects in the prism surfaces.

SUMMARY

Various drawbacks of these and other conventional technologies are addressed here by providing an industrial luminaire with a refractor including an interior surface formed as an open-ended surface of revolution of a plane curve about a rotational axis. The plane curve has a plurality of segments corresponding to segments on a reference curve which, for each segment of the reference curve, the corresponding segment on the plane curve has been incrementally rotated with respect to a reference point on a reference axis for the reference curve. For example, the reference curve may be a portion of a conic section and the reference point on the reference axis of the reference curve may be a focus of the conic section. The reference axis for the reference curve may also extend substantially perpendicular to a directrix of the conic section and the conic section may be an ellipse, a parabola, and a hyperbola.

In addition, a portion of the interior surface formed by at least one of the segments of the plane curve may include a plurality of circumferential prisms and each of the circumferential prisms may include at least one circumferential wall that is displaced from that segment of the plane curve toward an interior of the refractor. The circumferential wall may be arranged parallel to an opening of the refractor and/or arranged substantially horizontally.

The refractor may also have an exterior surface generally conforming to the surface of revolution that includes a plurality of exterior prisms arranged substantially parallel to the planar curve. Each of the exterior prisms may include a V-shaped groove extending substantially over the length of the plane curve and at least same of the V-shaped grooves may have a width that changes over the length of the plane curve.

BRIEF DESCRIPTION OF THE DRAWINGS

These and other aspects of this technology will now be described with reference to the following drawings. Various features in each figure have been drawn to scale relative to other features in the same figure and like reference numerals have been used to designate corresponding parts throughout the several views.

DETAILED DESCRIPTION OF THE PREFERRED EMBODIMENTS

Figure 1:
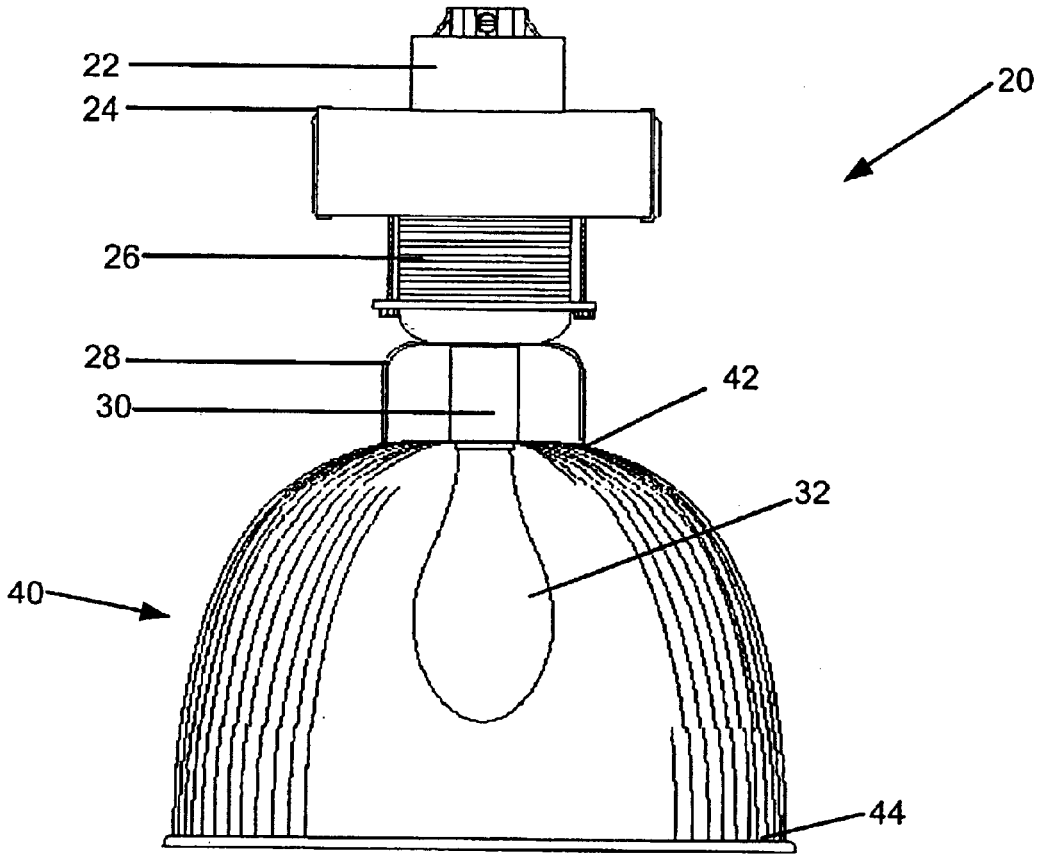
FIG. 1 is a side view of one embodiment of an industrial luminaire with a prismatic refractor.

FIG. 1 is a side view of one embodiment of an industrial luminaire 20. The luminaire 20 is depicted here as a high-bay luminaire; however, a variety of other luminaires may also be used with the technology described below, including, but not limited to, low-bay luminaires and non-industrial luminaires.

Although not shown in FIG. 1, the bottom of the luminaire 20 may be provided with a lens, such as a flat lens, conical lens, drop lens, bubble lens and/or other bottom enclosure, including those available from Lexalite Corporation of Charlevoix, Mich. (and www.lexalite.com), or as shown in the related co-pending design patent applications identified above.

The illustrated luminaire 20 is provided with a mounting box 22 for securing the luminaire to an overhead support. However, a variety of other support mechanisms may also be provided as is known in the art including fixture hooks, fixture loops, and hooks with safety screws. A housing 24 is connected to the mounting box 22 and contains various electrical components and/or connections for providing power to the luminaire 20. A ballast 26 is arranged below the housing 24. However, some or all of these components and connections may be arranged in the mounting box 22. Alternatively, the housing 24 and mounting box 22 may be combined as in the BENCHMARK HB Prismatic High Bay product available from Cooper Lighting.

In FIG. 1, a bracket 28 secures the lamp socket 30 and the refractor 40 to the rest of the luminaire 20. A lamp 32, or other illumination source, is arranged in the lamp socket 30, and preferably disposed along a central axis of the refractor 40 as discussed in more detail below. For example, a high intensity discharge lamp, such as, for example, a high pressure sodium, metal halide or mercury vapor lamp can be used for the light source 32. However, a variety of other commercially-available lamps may also be used be employed, including one or more compact fluorescent lamps or incandescent lamps.

The bracket 28 is preferably adjustable for vertically-positioning the lamp relative to the refractor 40 in order to control the width of the light distribution from the refractor 40. For example, Cooper Lighting offers various industrial luminaires with brackets that are adjustable in ⅜" increments identified as positions "A" through "L" on the side of the bracket. Other brackets with fewer positions simply identify those increments as corresponding to "concentrated," "medium," and "wide" beam dispersions corresponding to high, medium, and low positions of the lamp 32 in the refractor 40. Although the refractor 40 is configured in FIG. 1 to provide mostly direct, concentrated downlight, the refractor may also be inverted in order to provide indirect lighting and/or uplight, or directed toward a vertical wall to produce a "wall wash" effect.

The refractor 40 is preferably formed as a unitary body of translucent or transparent polymeric or glass material. For, example, the refractor 40 may be injection molded and/or machined from acrylic, polycarbonate, or other plastic material. However, other materials may also be used including, but not limited to, opaque materials such as aluminum, brass, and epoxy resin materials. Other manufacturing processes may also be used including casting, stamping, rotary molding, extrusion, coating and/or other processes.

Figure 2:
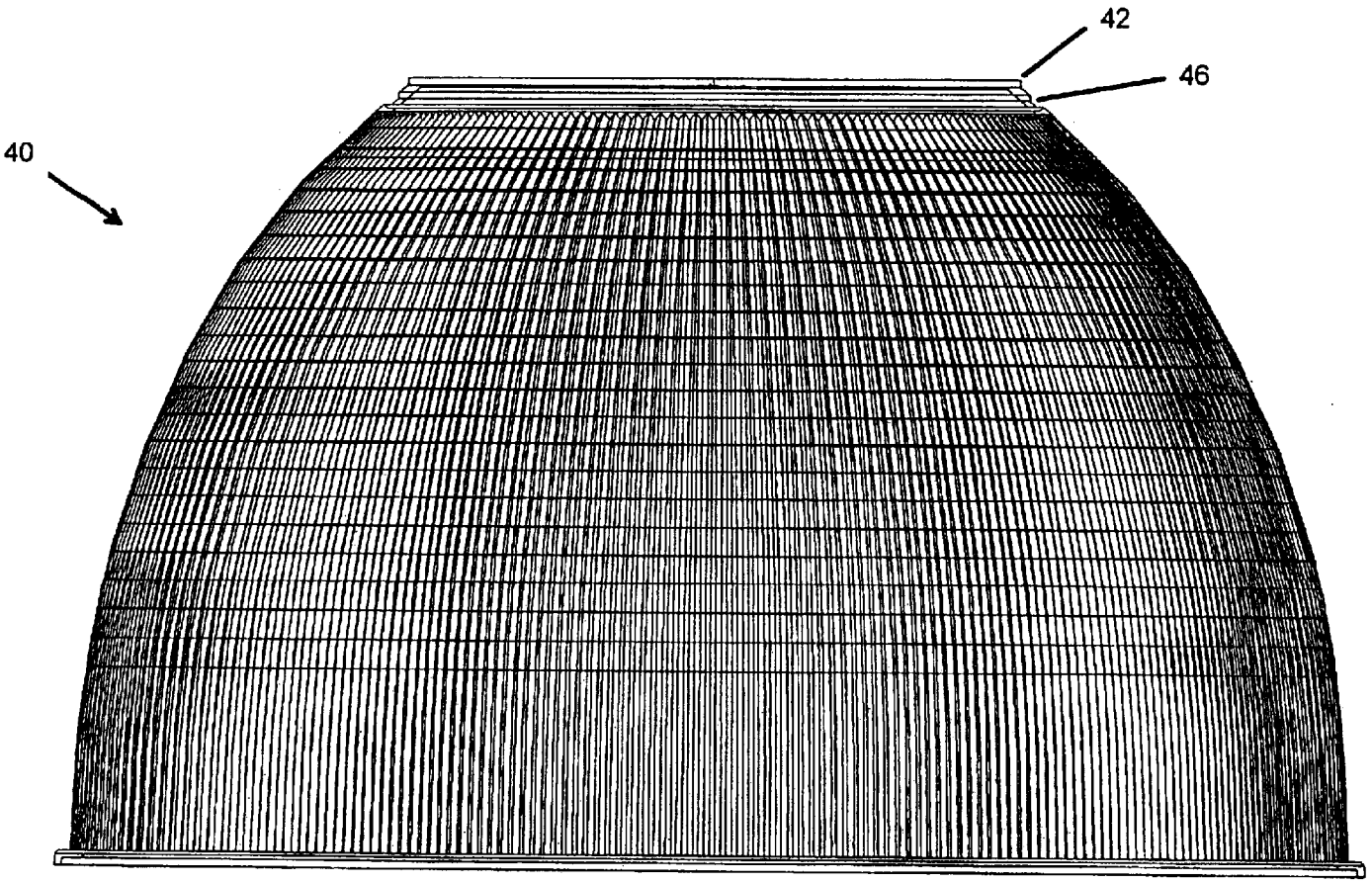
FIG. 2 is an enlarged side view of the refractor shown in FIG. 1.
Figure 12:
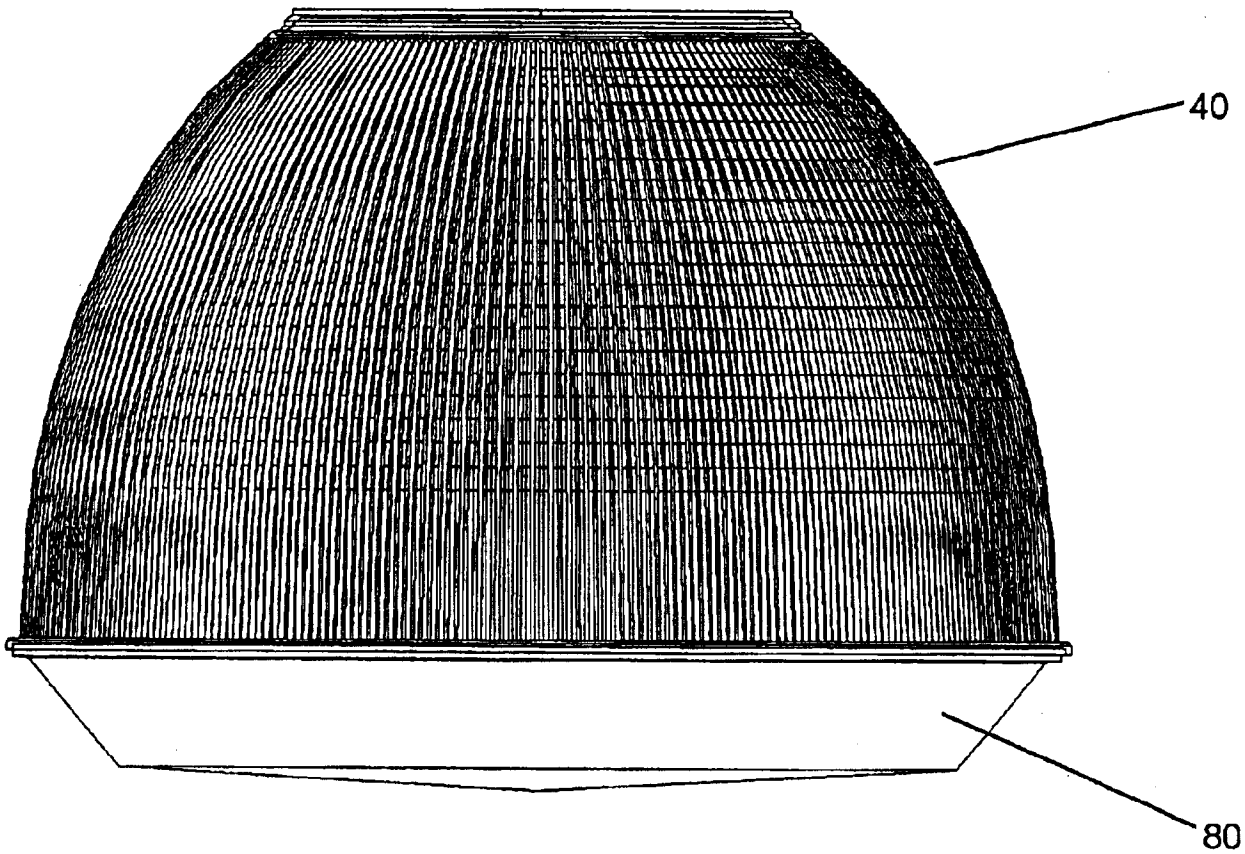
FIG. 12 is a side view of the refractor shown in FIG. 2 with a drop lens.

As shown in FIG. 2, refractor 40 has an upper rim 42 for securing to the bracket 28, or other supporting hardware, and a lower rim 44 for receiving a drop lens (shown in FIG. 12). The upper rim also includes an optional gasket ring 46 for receiving a gasket (not shown). In this configuration, the gasket can be used to seal the upper rim 42 of the refractor in order to prevent the infiltration of dust and/or water into the interior cavity of the refractor 40. For example, appropriate hardware for sealing the upper rim 42 of the refractor 40 is available, for example, from Cooper Lighting as Model Nos. ENPD and FP for so-called "enclosed and gasketed" luminaires.

Figure 3:
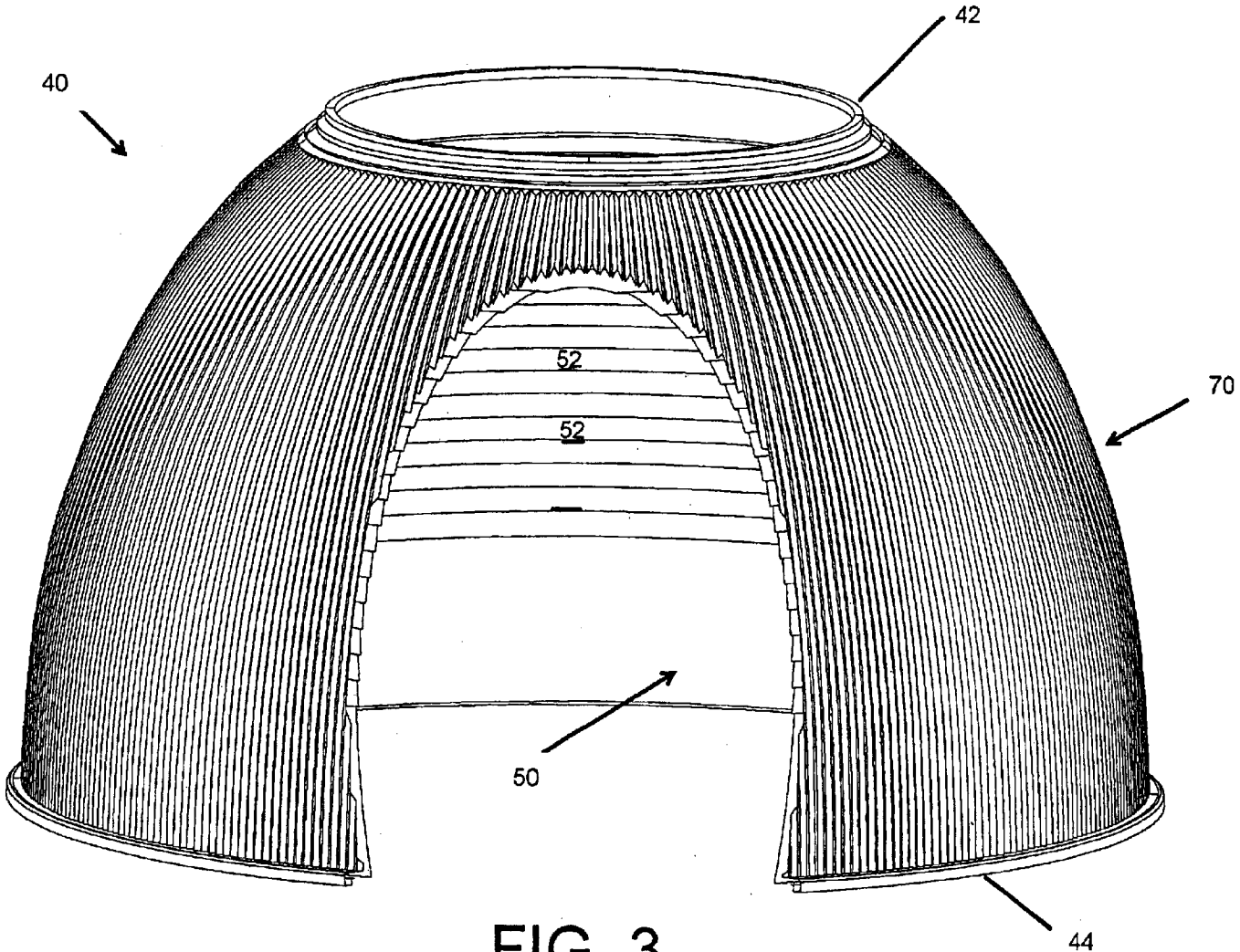
FIG. 3 is a schematic, cutaway isometric view comparing the interior and exterior surfaces of the refractor in FIG. 2.

FIG. 2 illustrates a translucent embodiment of the refractor 40 where interior features of the refractor can be seen through the exterior surface. FIG. 3 is a schematic, cutaway isometric view of the refractor 40 from FIG. 2 comparing the interior surface 50 to the exterior surface 70 of the refractor. In other words, FIG. 3 shows the interior surface of the refractor 40 in only the cutaway portion, and, in this regard, corresponds to what the refractor 40 in FIG. 2 would generally look like if made from an opaque material.

Figure 4:
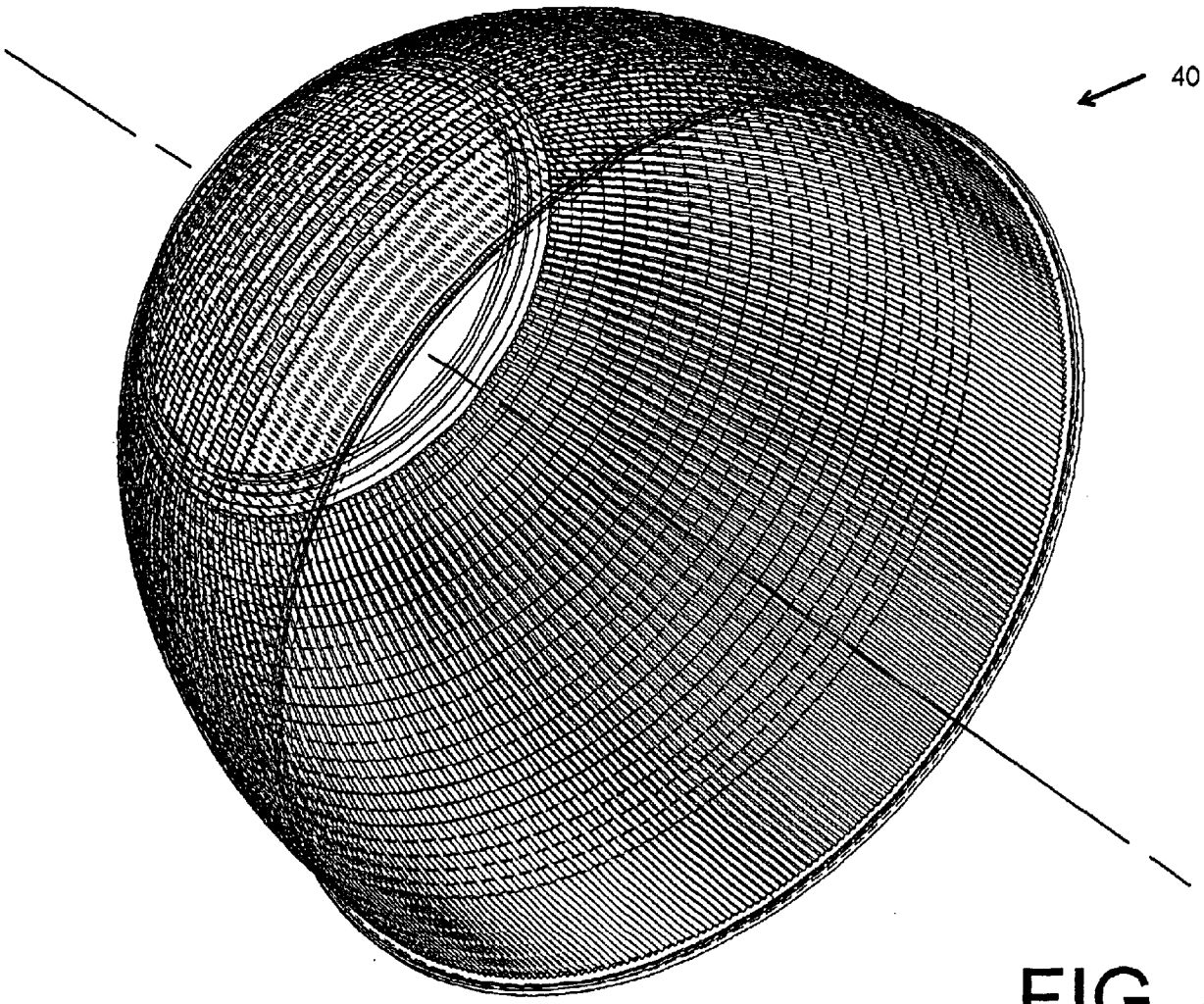
FIG. 4 is a bottom isometric view of the refractor shown in FIG. 2.

FIG. 3 illustrates a plurality of interior, circumferential prisms 52 arranged on the interior surface or wall 50, and a plurality of exterior, longitudinal prisms 72 arranged on the exterior surface or wall 70. Although the interior prisms 52 are illustrated in FIGS. 2 and 3 as being arranged substantially horizontal, and the exterior prisms 72 are illustrated as being arranged substantially vertical, they may, in fact, be arranged at other angles. For example, FIG. 4 is a bottom isometric view of the refractor 40 shown in FIG. 2 which the axis shown by the centerline has been rotated approximately 45° from nadir so that the interior prisms 52 and exterior prisms 72 are neither horizontal nor vertical. Similarly, although the interior prisms 52 and exterior prisms 72 have been illustrated as being arranged substantially perpendicular to each other, other relative angles may also be used between the interior and exterior prisms including 0°, 5°, 10°, 15°, 30°, 45°, 60°, and 75° and/or combinations thereof.

The location of the interior prisms 52 and exterior prisms 72 may also be reversed so that interior, circumferential prisms 52 are arranged on the exterior wall 70 while longitudinal prisms 72 are arranged on the interior wall 50. Alternatively, some or all of the circumferential and longitudinal prisms may be arranged on the same interior surface 50 and/or exterior surface 70 of the refractor 40. In yet another alternative, the circumferential and/or longitudinal prisms may be arranged beneath the interior and/or exterior surfaces 50, 70 of the refractor 40. For example, one or both of the interior surface 50 and exterior surface 70 may be covered with a coating or additional layer of reflective, non-reflective, refractive, non-refractive and/or other materials.

The refractor 40 is generally shaped as an open-ended, shell of a surface of revolution. The term "surface of revolution" is used here in its mathematical sense to describe a surface generated by rotating a two-dimensional "plane curve" about an axis. Examples of surfaces of revolution include the apple, cone (excluding the base), conical frustum (excluding the ends), cylinder (excluding the ends), Darwin-de Sitter spheroid, Gabriel's horn, hyperboloid, lemon, oblate spheroid, paraboloid, prolate spheroid, pseudosphere, sphere, spheroid, and torus (and its generalization, the toroid).

As discussed in more detail below with regard to FIG. 8, the plane curve that is used to generate the surface of revolution for the refractor 40 preferably includes one or more conic sections. In simple terms, conic sections, or "conics," are formed by the intersection of a right circular cone and a plane. The cone may have any vertex angle; however, it is the angle of intersection between the cone and the plane that determines whether the resulting curve is an ellipse, parabola, or hyperbola.

In mathematical terms, a conic can also be defined in terms of a "directrix" line D, and a "focus" point F not on D, where the conic is the locus of points P such that the distance from P to F divided by the distance from P to D is a constant referred to as the "eccentricity." If the eccentricity is equal to 1, the resulting conic is a parabola, while eccentricities less than 1 result in an ellipse and eccentricities greater than 1 result in a hyperbola. The ellipse and hyperbola are also known as "central conics."

The solid formed by the revolution of a conic section about its axis is referred to as a "conoid." If the conic section is a parabola, the resulting solid is a parabolic conoid or "paraboloid." Similarly, if the conoid is a hyperbola, then the solid is referred to as a hyperbolic conoid, or "hyperboloid," while an ellipse forms an elliptic conoid, also known as an "ellipsoid." The term "conoid" is used here to include truncated conoids, and/or other partial conoids. The term "conoid shell" is used here to generally refer to a thin wall of substantially uniform thickness including an external surface of a conoid.

Figure 5:
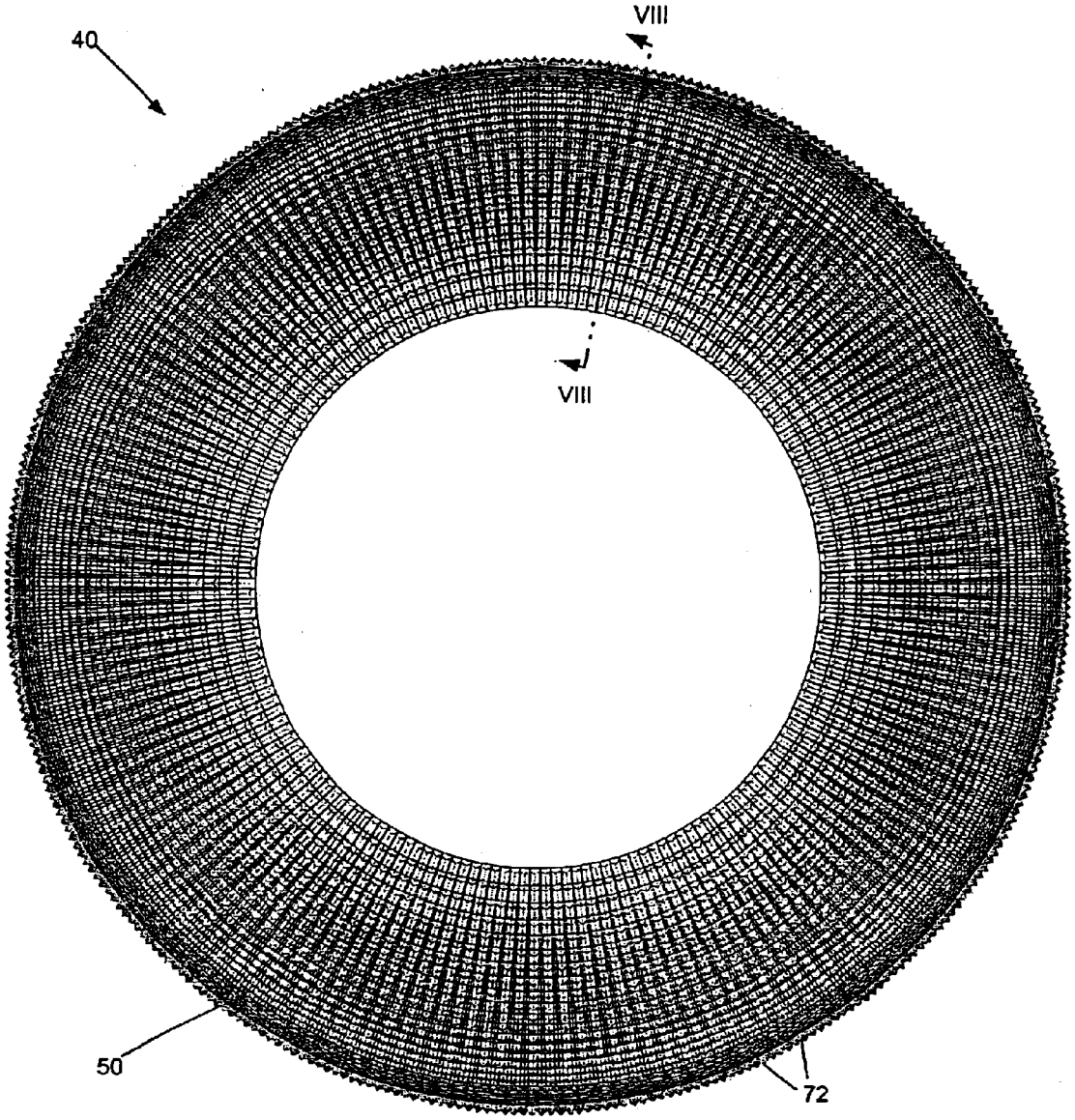
FIG. 5 is a partial top view of the refractor of FIG. 2.
Figure 6:
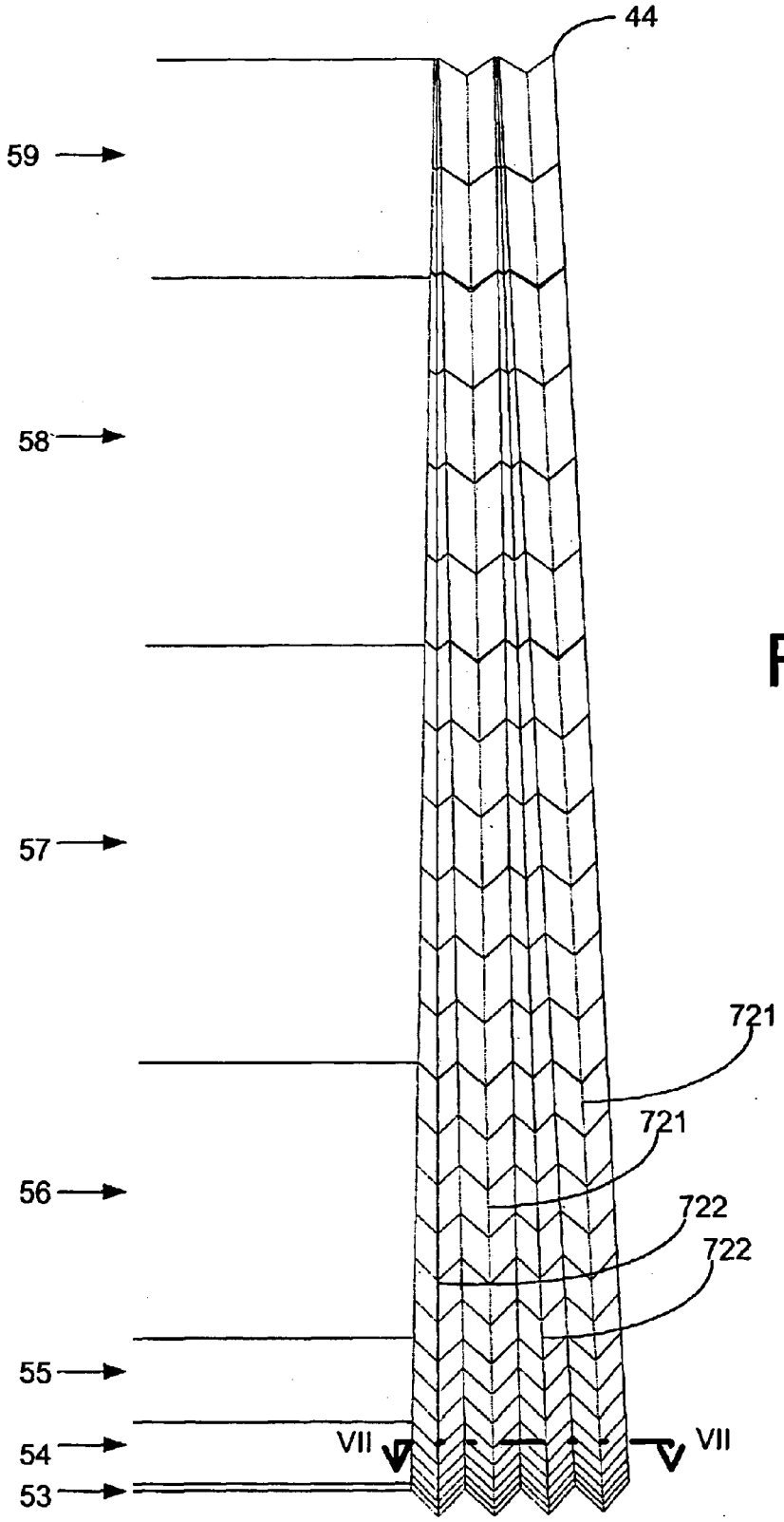
FIG. 6 is an enlarged top view of a portion of the refractor shown in FIG. 5.
Figure 7:
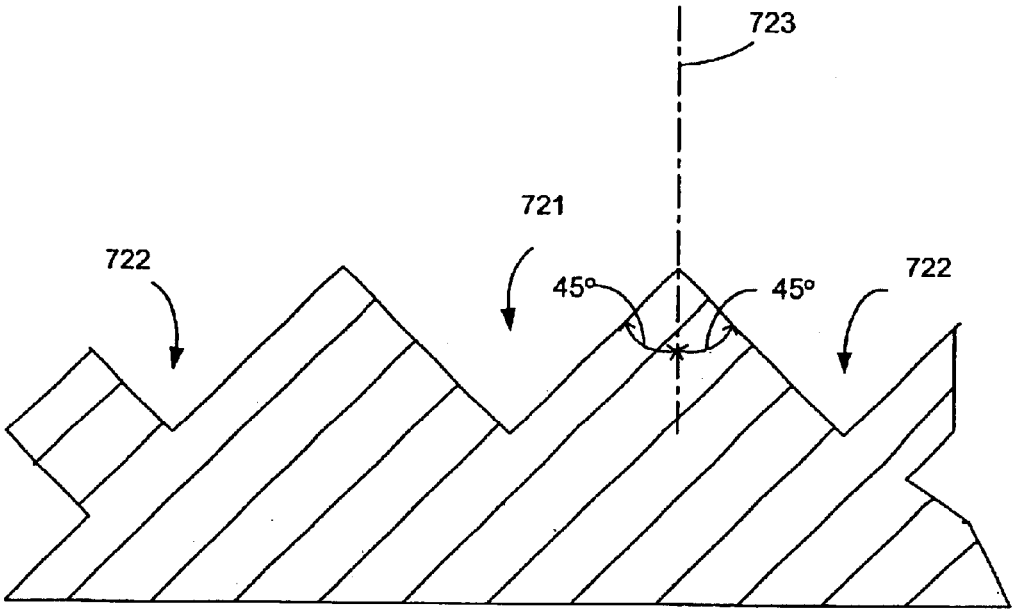
FIG. 7 is a partial, cross-sectional view of the reflector taken along section line VII—VII in FIG. 6.

FIG. 5 is a partial top view of the translucent refractor 40 shown in FIGS. 2 and 4 where the upper rim 42, lower rim 44, and gasket ring 46 have been removed for simplification. FIG. 6 is an enlarged view of a portion of the exterior surface 70 of the refractor 40 shown in FIG. 5. FIG. 7 is a partial cross-section taken along section line VII—VII in FIG. 6.

As best illustrated in FIGS. 5–7, the exterior surface 70 of the refractor 40 includes a plurality of flutes configured as V-shaped exterior prism elements 72. FIG. 5 illustrates 360, longitudinal V-shaped prism elements 72 that are equally spaced around the circumference of the refractor 40 near the bottom rim 44. However, other numbers, configurations, and shapes of elements may also be used including U-shaped and channel-shaped prism elements. The exterior prism elements may also be clustered in just certain sectors of the exterior surface 70, for example, to provide substantially rectangular, square, elliptical, and/or other non-circular light distribution patterns.

In the figures, the exterior prism elements 72 are labeled at the bottom apex of each V-shaped groove. All of the illustrated exterior prism elements 72 extend from near the top rim 42 (not shown in FIG. 5) to near the bottom rim 44 (also not shown in FIG. 5) of the refractor 40. Alternatively, some or all of the exterior prisms 72 may extend across only part of the longitude of the exterior surface 70 of the refractor 40.

As best shown in FIG. 6, some of the exterior prism elements 72 have a constant width while others have a variable width. More specifically, constant-width prism elements 721 are alternated with blended, or variable-width, prism elements 722. However, other ratios and/or arrangements of constant-width prism elements 721 and variable-width prism elements 722 may also be used including the use of only constant-width prism elements or only variable-width prism elements.

As the name implies, the variable-width prism elements 722 have a peak to peak width that increases with the length of the prism element, along the longitude of the refractor 40 from the top to the bottom of the refractor. Alternatively, some or all of the variable-width prism elements 722 may have a width that decreases from the top to the bottom of the refractor 40. Furthermore, although the rate of change of the width of the variable-width prism elements 722 is illustrated in the drawings as being substantially constant over the longitude to the refractor 40, variable and/or discontinuous rates of width change may also be used.

For the embodiment illustrated in the figures, the constant-width prism elements 721 are spaced every 2° near the top rim 42 of the refractor 40 so that 180 constant-width prism elements 721 are equally spaced near the top of the refractor. However, other numbers of prism elements and/or spacing intervals may also be used. Near the lower rim 44 of the refractor 40, the constant-width prism elements 721 and the variable-width prism elements 722 have substantially the same peak to peak width so that 360 exterior prism elements 72 are evenly spaced at 1° intervals. As best illustrated in FIG. 7, the peak of each leg of the exterior prism elements 72 is preferably angled at 45° from a radial line 723 extending perpendicular from the central axis of the refractor 40 shown in FIG. 4. Since the exterior circumference of the refractor 40 is curved, this configuration results in the troughs of the prism elements 72 having legs that are angled at slightly more than 45° from a radial centerline, or slightly more than 90° from each other. However, other angular configurations may also be used so that light rays impinging thereon will be reflected or refracted as the incident angle is greater than or less than the critical angle of the translucent material.

Figure 8:
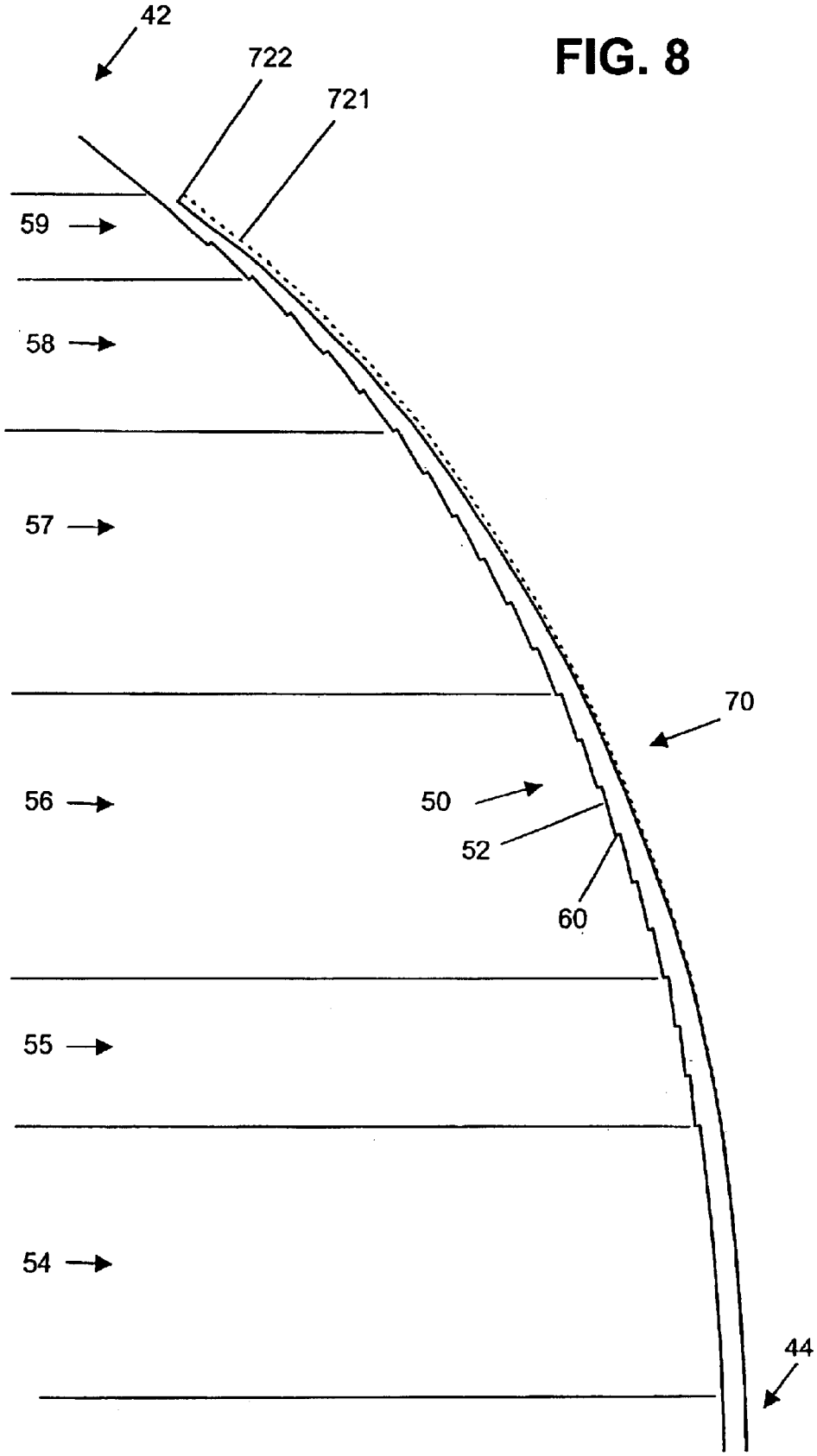
FIG. 8 is a partial, cross-sectional view of the wall refractor taken along section line VIII—VIII in FIG. 5.

FIG. 8 is a partial, cross-sectional view of the wall, or shell, of the refractor 40 taken along section line VIII—VIII in FIG. 5. In FIG. 8, the solid line on the left corresponds to the interior surface 50, the solid line in the middle corresponds to the base of the V-shaped groove forming constant width prisms 721, and the broken line corresponds the base of the V-shaped groove forming variable-width prisms 722. On the exterior wall 70, the variable-width prism elements 722 start from zero, or near zero, depth near the top rim 42 of the refractor 40 and becomes deeper and wider as the prism 722 extends longitudinally downward over the external surface 70. At the bottom rim 44, the depth and width of the variable width prism 722 are substantially the same as that of the adjoining constant-width prism 721.

As illustrated in FIG. 8, the plane curve forming the internal surface (of revolution) 50 of the refractor 40 is divided into several segments 53–59, several of which include one or more of the circumferential prisms 52. The segments 53–59 are portions of the planar curve that was used to provide the surface of revolution. Although seven parabolic segments are illustrated in the figures, any number of parabolic, hyperbolic, elliptic, and/or other conic section segments may also be used.

Figure 9A:
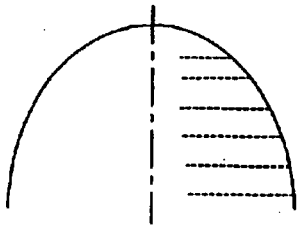
FIGS. 9A through 9D are a schematic illustration of segment positions for a rotated reference parabola.
Figure 9B:
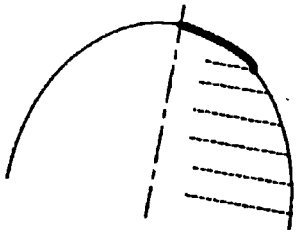
Figure 9C:
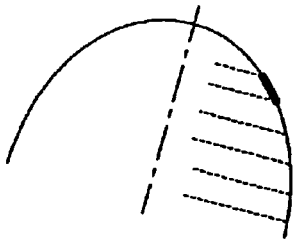
Figure 9D:
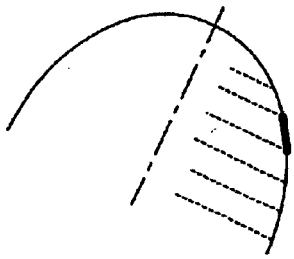
Figure 9E:
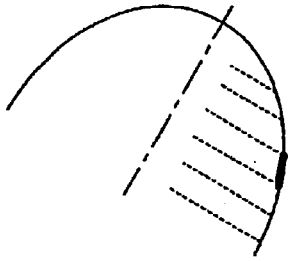

Each of the parabolic segments 53–59 is taken from a corresponding segment of a reference parabola where each adjacent segment has been incrementally tilted, or rotated, about a reference point as is schematically illustrated in FIGS. 9A–9E. For example, FIG. 9A illustrates an un-rotated reference parabola having one side that has been divided into a plurality of segments shown by dashed lines. In FIG. 9B, the reference parabola from FIG. 9A has been rotated clockwise 5° in order to obtain the orientation of the first segment shown in bold. FIG. 9C shows the reference parabola rotated another 5° in order to obtain the orientation of the next adjacent segment of the parabola. Similarly, FIGS. 9D and 9E show the reference parabola from FIG. 9A rotated 15° and 20°, respectfully, in order to obtain the orientation of the third and fourth segments, respectfully, also shown in bold. A plane curve similar to the one that was used to form the interior surface 50 and exterior surface 70 of the refractor 40 can then be made by joining consecutive rotated parabola segments shown in bold in FIGS. 9B–9E. The reference parabola in FIG. 9A is preferably rotated about the light center point on the center line in FIGS. 9B–9E. However, other rotational reference points may also be used, including the focus of the parabola.

Returning to FIG. 8, segments 53, 54, 55, 56, 57, 58, and 59 correspond to segments of a reference parabola which has been rotated about its focus 49.3267°, 49.3200°, 45°, 40°, 35°, 30°, and 25°, respectively. However, other rotations may also be used. For a nominal 22-inch refractor 40 having bottom opening of about 21.5 inches, a top opening of about 10 inches, and a vertical height of about 13.5 inches, the lower segment 53 is approximately 0.75 inches in length.

As noted above, segments 55–59 in FIG. 8 are further provided with circumferential prism elements 52. For the nominal 22-inch refractor illustrated in the figures, the circumferential prism elements 52 are preferably about ½ inch in vertical width. However, other widths may also be used and the prism elements 52 may extend only part way around the circumference of the interior surface 50. One or more of the interior prism elements 52 may also be broken or discontinuous around the circumference.

Each prism element 52 is rotated by about 1–10°, and preferably about 5°, from the segmented parabolic curve forming the interior surface of revolution. More specifically, the top edge of each prism element 52 is fixed while the bottom edge of each prism element is rotated about 5° toward the interior of the refractor 40. However, other rotational configurations may also be used. For example, each prism element 52 may be rotated about another point on the element, such as its center-point.

The bottom, inwardly-extending wall 60 of each of the interior prism elements 52 is preferably arranged to form a surface which is substantially parallel to the opening of the reflector 40. For the configuration illustrated in the side view of FIG. 1, the walls 60 will be arranged substantially horizontal to the surface being illuminated. However, other arrangements of the walls 60 may also be used depending upon the location of the illumination surface relative to the opening of the refractor 40.

Table 1 below provides zonal, efficiency and SC data for various bracket positions of the luminaire 20 with the refractor 40 described above.

TABLE 1

| | | Refractor 40 | | | | | | | | | | | |
|---|---|---|---|---|---|---|---|---|---|---|---|---|---|
| | | 0–30° Efficiency | | 0–40° Efficiency | | 0–60° Efficiency | | 0–90° Efficiency | | 90–180° Efficiency | | 0–180° Efficiency | |
| Pos. | SC | % L | % F | % L | % F | % L | % F | % L | % F | % L | % F | % L | % F |
| A | 0.6 | 34.8 | 41.2 | 46.8 | 55.2 | 56.0 | 66.2 | 62.7 | 74.1 | 22.0 | 25.9 | 84.6 | 100 |
| B | 0.7 | 35.4 | 41.4 | 48.2 | 56.5 | 58.5 | 68.5 | 65.2 | 76.4 | 20.1 | 23.6 | 85.4 | 100 |
| C | 0.7 | 35.1 | 40.7 | 48.8 | 56.6 | 60.2 | 69.9 | 67.1 | 77.9 | 19.0 | 22.1 | 86.2 | 100 |
| D | 0.8 | 34.1 | 39.4 | 48.5 | 55.9 | 61.5 | 71.0 | 68.6 | 79.2 | 18.0 | 20.8 | 86.6 | 100 |
| E | 0.9 | 32.8 | 37.5 | 47.7 | 54.6 | 62.6 | 71.6 | 70.0 | 80.0 | 17.5 | 20.0 | 87.5 | 100 |
| F | 1 | 30.8 | 35.0 | 46.3 | 52.6 | 63.1 | 71.7 | 70.9 | 80.5 | 17.1 | 19.5 | 88.0 | 100 |
| G | 1.2 | 29.4 | 33.0 | 45.3 | 50.9 | 63.7 | 71.7 | 71.9 | 80.9 | 17.0 | 19.1 | 88.9 | 100 |
| H | 1.4 | 26.7 | 29.9 | 42.9 | 48.0 | 63.7 | 71.3 | 72.4 | 81.1 | 16.8 | 18.9 | 89.3 | 100 |
| J | 1.6 | 24.0 | 26.7 | 40.4 | 45.0 | 63.6 | 70.7 | 73.1 | 81.3 | 19.8 | 18.7 | 89.9 | 100 |
| K | 1.8 | 20.1 | 22.5 | 36.2 | 40.5 | 61.9 | 69.2 | 72.6 | 81.3 | 16.8 | 18.7 | 89.4 | 100 |
| L | 2 | 17.5 | 19.3 | 33.0 | 36.4 | 60.7 | 66.9 | 73.0 | 80.5 | 17.7 | 19.5 | 90.7 | 100 |

Table 2 provides similar data for a few of the same bracket positions of a luminaire 20 where the refractor 40 has been replaced with a Model 822 prismatic REFLEXOR® from LexaLite Corporation.

TABLE 2

Model 822 REFLEXOR ® from LexaLite Corporation

| | | 0–30° Efficiency | | 0–40° Efficiency | | 0–60° Efficiency | | 0–90° Efficiency | | 90–180° Efficiency | | 0–180° Efficiency | |
|---|---|---|---|---|---|---|---|---|---|---|---|---|---|
| Pos. | SC | % L | % F | % L | % F | % L | % F | % L | % F | % L | % F | % L | % F |
| A | — | — | — | — | — | — | — | — | — | — | — | — | — |
| B | — | — | — | — | — | — | — | — | — | — | — | — | — |
| C | 1.1 | 31.9 | 36.6 | 47.0 | 53.9 | 58.4 | 66.9 | 66.7 | 76.5 | 20.5 | 23.5 | 87.3 | 100 |
| D | — | — | — | — | — | — | — | — | — | — | — | — | — |
| E | 1.3 | 29.1 | 32.8 | 46.0 | 51.8 | 60.5 | 68.2 | 69.6 | 78.5 | 19.1 | 21.5 | 88.7 | 100 |
| F | — | — | — | — | — | — | — | — | — | — | — | — | — |
| G | 1.6 | 24.7 | 27.2 | 43.1 | 47.3 | 62.2 | 68.4 | 72.3 | 79.4 | 18.7 | 20.6 | 91.0 | 100 |
| H | — | — | — | — | — | — | — | — | — | — | — | — | — |
| J | — | — | — | — | — | — | — | — | — | — | — | — | — |
| K | — | — | — | — | — | — | — | — | — | — | — | — | — |
| L | 2.1 | 14.8 | 15.9 | 30.2 | 32.5 | 59.2 | 63.5 | 73.1 | 78.5 | 20.1 | 21.5 | 93.2 | 100 |

Figure 10:
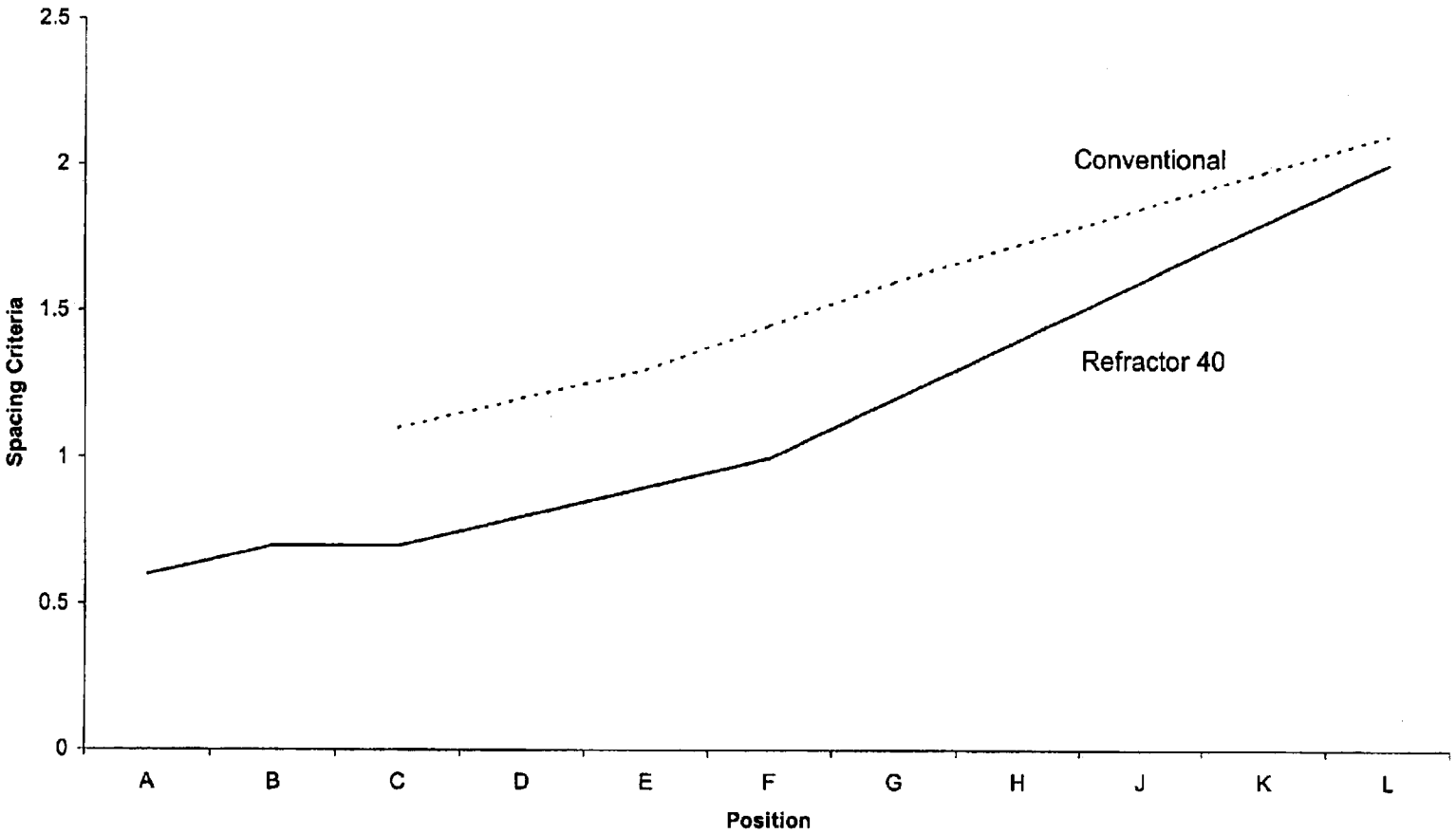
FIG. 10 is a comparison plot of bracket position verse spacing criteria for the refractor shown in FIG. 2 and a conventional refractor.
Figure 11A:
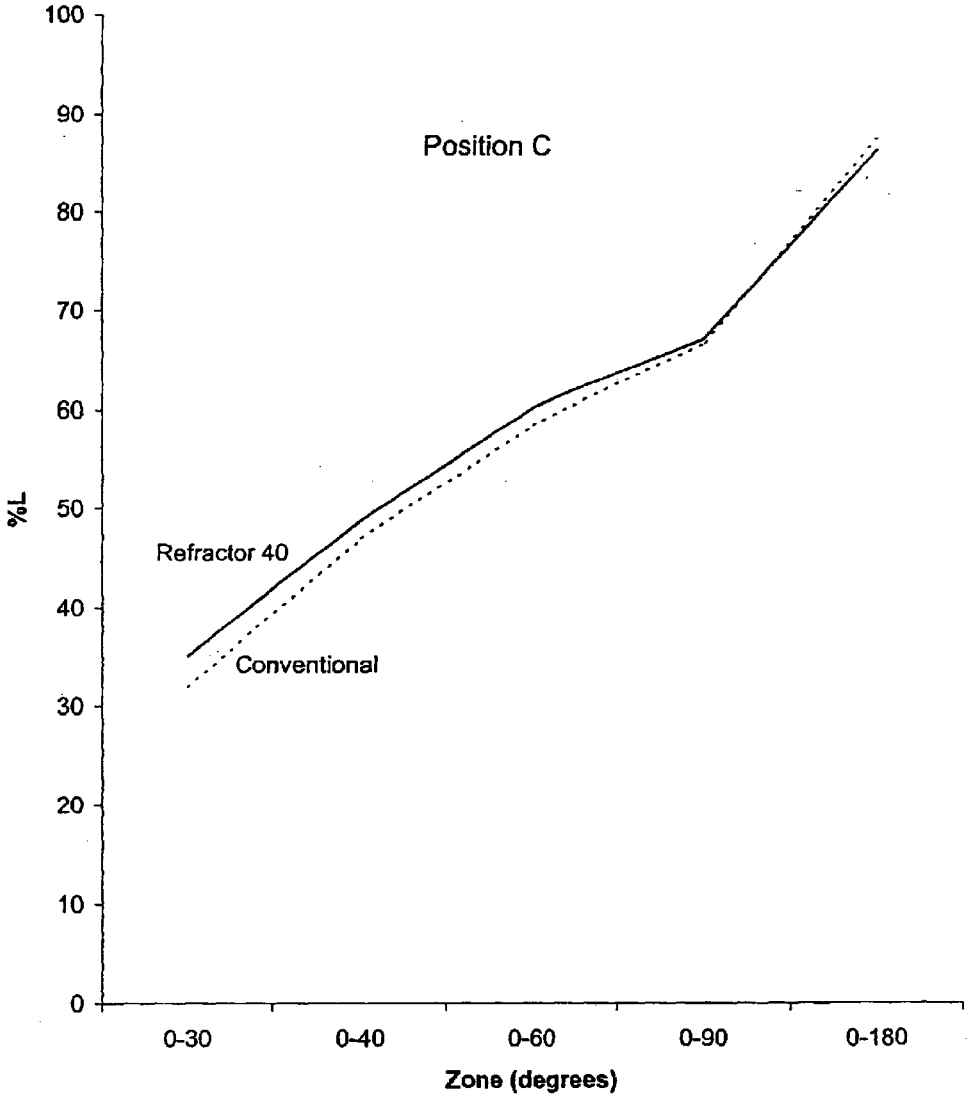
FIGS. 11A–11D are comparison plots of zonal lumen data for various bracket positions of the luminaire shown in FIG. 1 and a modified luminaire including a conventional refractor.
Figure 11B:
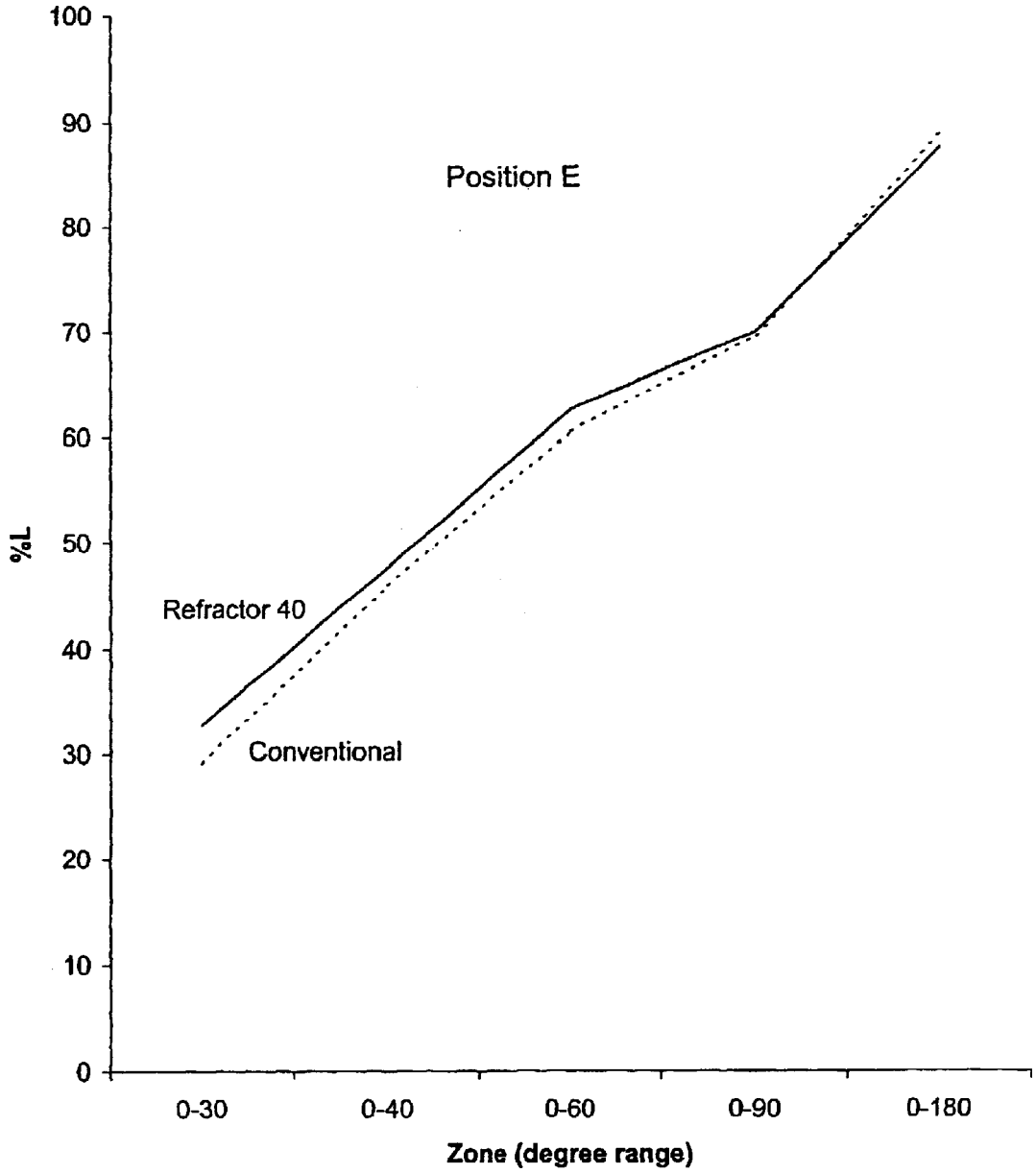
Figure 11C:
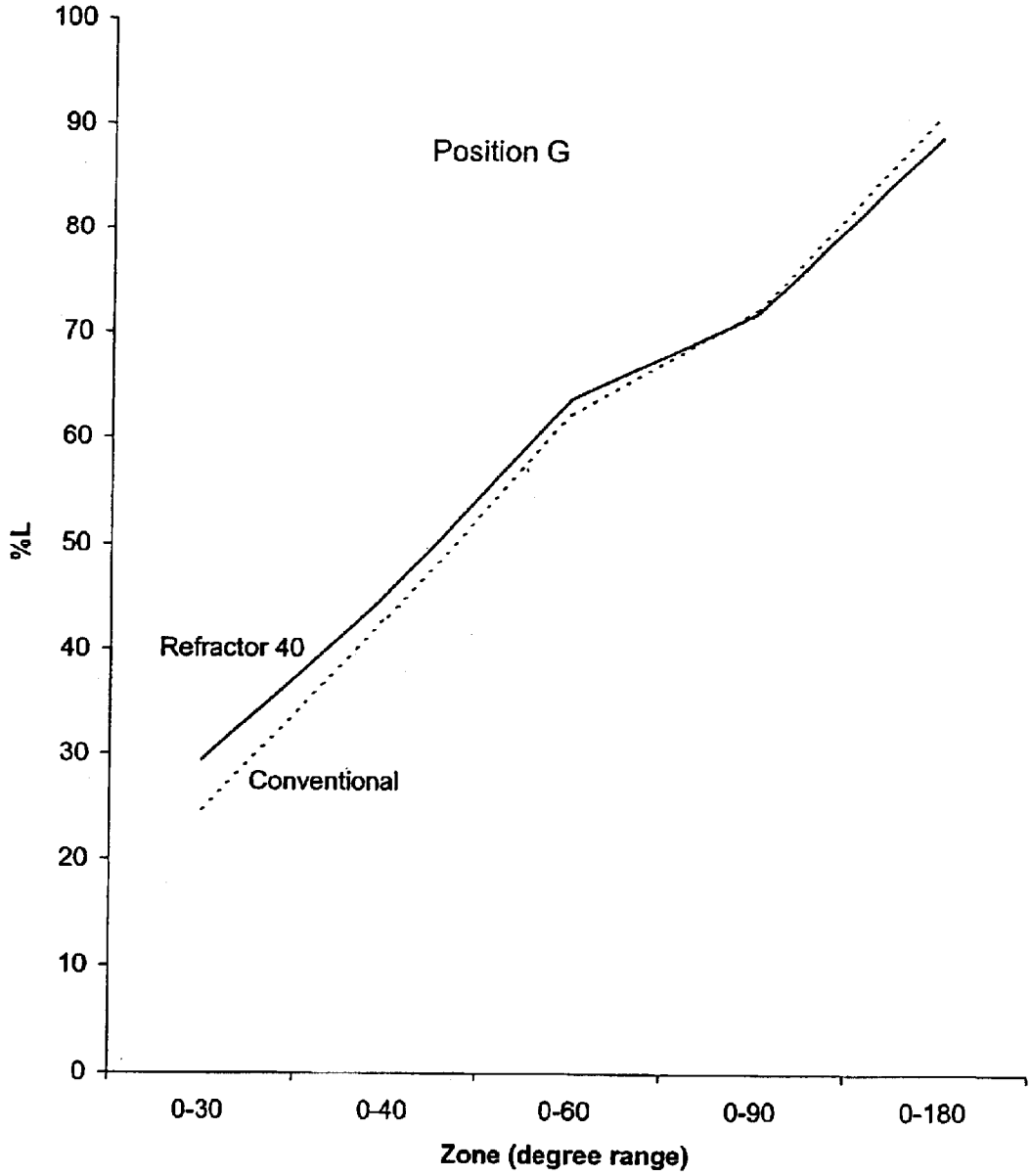
Figure 11D:
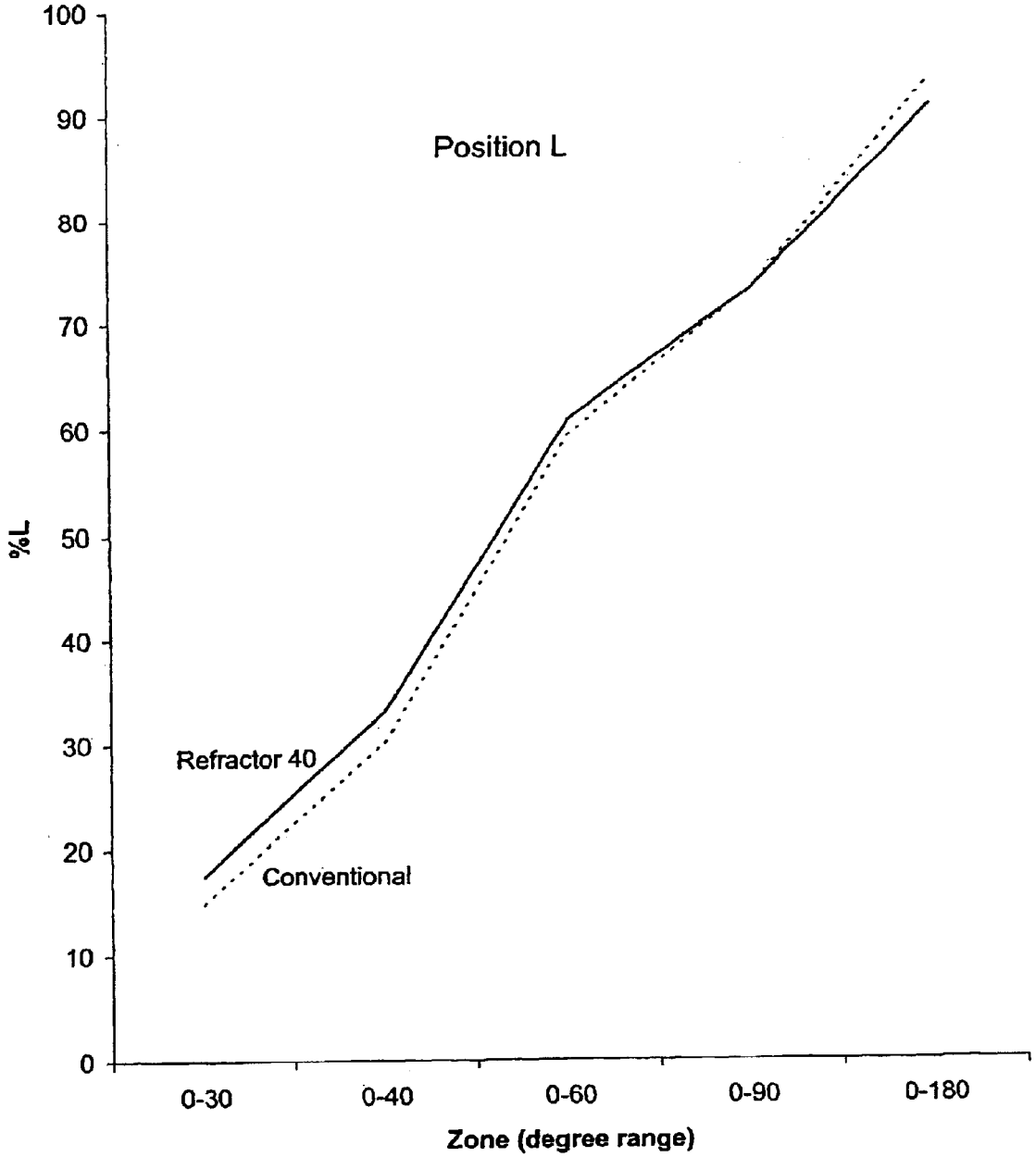

FIG. 10 is a comparison plot of bracket position versus spacing criteria for the luminaire shown in FIG. 2 with Refractor 40 (Table 1) and one that has been modified by replacing the refractor 40 with a 22-inch, Model 822 prismatic REFLEXOR® from LexaLite Corporation. FIG. 10 illustrates that the range of spacing criteria provided by the refractor 40 for positions C–L is greater than the range of spacing criteria for the conventional refractor. This shows that the refractor 40 has a greater range of adjustability, at least between positions C and L. Moreover, it is expected that additional testing of the conventional refractor at positions A and B would simply extend the plot for the conventional refractor at substantially the same slope.

FIGS. 11A–11D are comparison plots of zonal lumen data for various bracket positions of a luminaire 20 with the refractor 40 shown in FIG. 1 and a modified luminaire with the 22-inch, Model 822 prismatic REFLEXOR®) from LexaLite Corporation. FIGS. 11A–11D correspond to bracket positions C, E, G, and L, respectively. In each of these plots, it will be noted that the refractor 40 provides a slightly higher overall efficiency for the 0–180° zone as compared to the conventional refractor. However, the refractor 40 provides significantly higher efficiencies for zones that are less than about 0–90°.

In fact, this is the preferred result for many industrial applications where a narrow light distribution pattern is preferred. For example, in many applications for high-bay industrial luminaires, the light which is distributed at the higher angles is undesirable because all of the human activity takes place near the floor. Consequently, light which is omitted at the higher angled zones is not very useful and should be avoided in any refractor design.

FIG. 12 is a side view of the refractor 40 fitted with a drop down lens 80. A variety of drop down lens may be used including the models 622 and 630 available as part of the LexaLite 600 Series of indoor and outdoor area lighting. Conical lenses may also be used. The lens 80 may be secured to the refractor 40 in a variety of ways including the use of various bands, fasteners, adhesives, and/or other devices as are known in the art.

Figure 13A:
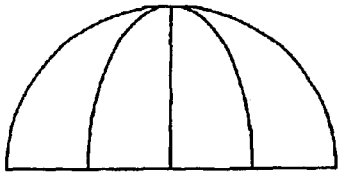
FIGS. 13A–13D are schematic views of a mold for use in making the refractor shown in FIG. 2.
Figure 13B:
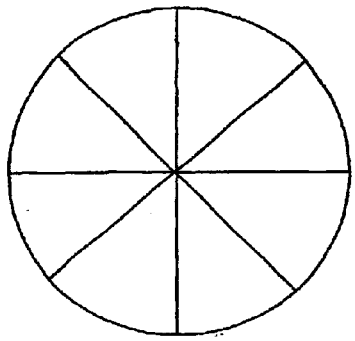
Figure 13C:
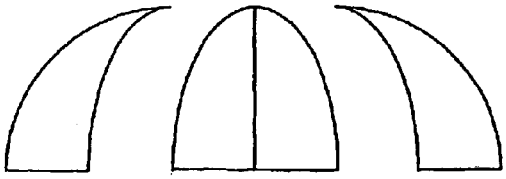
Figure 13D:
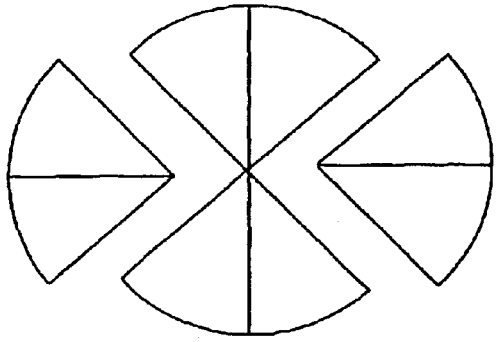

FIGS. 13A–13D are schematic views of a mold for use in making the refractor shown in FIG. 2. FIGS. 13A and 13B are side and top views, respectively, of the exterior of the mold in its closed position while FIGS. 13C and 13D, on the other hand, are side and top views, respectively, of the exterior of the mold in an open position. FIGS. 13C and 13D illustrate how various sectors of the exterior mold may be removed and/or replaced. For example, if a different pattern of exterior prism elements 72 is required for one section of the exterior of the refractor 40, then that section of the mold may be removed and/or replaced. In this way, various radial distributions of light may be engineered for only certain sections of the refractor 40.

In order to test the refractor 40, three acrylic prototypes were constructed using a variety of manufacturing specifications as discussed in more detail below. It was found that by increasing the surface finish of tool that was used to shape the interior surface 50 (core side of the mold shown in FIGS. 13A–13D) about 12 microns to 8 microns, the overall efficiency of the luminaire at position G increased from 80.4% to 89.6%. At position H, the overall efficiency was found to increase from 83.4% to 89.9% while at position J the efficiency increased from 85.8% to 89.9%.

In addition, it was found that increasing the surface finish of the tool to 6 microns and making the walls 60 (FIG. 8) substantially horizontal, further decreased the overall efficiency at position G from 89.6% to 88.9%. However, along with this decrease in overall efficiency came an increase in efficiency at the lower angles. For example, at 0° to 30° for position G the zonal efficiency increased from 28.4% to 29.4%, and at 0° to 40° the efficiency increased from 44.3% to 45.3%. Furthermore, at position J, the overall efficiency of the third prototype was substantially the same as the second prototype while the efficiencies at the lower angles were still higher for the third prototype than the second prototype.

This latter data showed that for higher spacing criteria (bracket positions later in the alphabet), the overall luminaire efficiency stayed substantially the same with improved tool finish and more-precise cutting of the walls 60 (FIG. 8). Nonetheless, zonal efficiency at lower angles continued to improve with the surface finish of the tool and improved tolerances for the internal prism elements 52.

Photometric data for position L, the highest spacing criteria that was tested, is set forth in Table 3 below for a luminaire 20 with the refractor 40 a similar luminaire that has been modified with the LexaLite Model 822.

TABLE 3

| | | Refractor 40 and Conventional Refractor at Position J | | | | | | | | | |
|---|---|---|---|---|---|---|---|---|---|---|---|
| | | 0–30° Efficiency | | 0–40° Efficiency | | 0–60° Efficiency | | 0–90° Efficiency | | 0–180° Efficiency | |
| Refractor | SC | % L | % F | % L | % F | % L | % F | % L | % F | % L | % F |
| 40 | 2 | 17.5 | 19.3 | 33.0 | 36.4 | 60.7 | 66.9 | 73.0 | 80.5 | 90.7 | 100 |
| Conv. | 2.1 | 14.8 | 15.9 | 30.2 | 32.5 | 59.2 | 63.5 | 73.1 | 78.5 | 93.2 | 100 |

In Table 3, the overall efficiency of the luminaire 20 with the refractor 40 (SC=2) was 90.7% while the efficiency was 93.2% with the conventional refractor (SC=2.1). However, at 0–30° the zonal efficiencies for the refractor 40 provided 17.5% zonal efficiency while the conventional refractor provided only 14.8% zonal efficiency. Although these zonal efficiency differences become less pronounced with larger zones, they continue into the 0–90° zone. This illustrates a significant improvement over the conventional refractor because the smaller zones are where the light is often most useful for luminaires which are mounted at greater heights.

Various thermal tests were also performed on the luminaire 20 with refractor 40 and it was found that with a 450 Watt, M144 lamp in a 55° C. environment, the top of a nominal 22-inch, acrylic, refractor 40 did not exceed 90° C. even when the bracket was in position A. This exceptional thermal performance was thought to be due to increased turbulence near the interior wall 50 of the luminaire 40 caused by the sharper angles provided by horizontal walls 60 of the prism elements 52.

It should be emphasized that the various embodiments of the technology described above and, particularly, any "preferred" embodiments, are merely examples of various implementations that have been used here to set forth for a clear understanding of the technology. Many variations and modifications may be made to these embodiments without departing substantially from the spirit and principles of the invention defined by the following claims.

What is claimed is:

1. A method of manufacturing a refractor for a luminaire, the method comprising:

providing a reference curve having a reference axis, the reference curve being rotatable with respect to a reference point on the reference axis;

creating a plane curve from the reference curve, the plane curve having a plurality of segments connected end to end, the segments of the plane curve corresponding to segments on the reference curve that have been Incrementally rotated with respect to the reference point on the reference axis; and forming a shell of a refractor by patterning the general shape of the shell as a surface of revolution of said plane curve about a rotational axis.

2. The method of claim 1, wherein the reference curve is a portion of a conic section.

3. The method of claim 2, wherein the reference point on the reference axis is a focus of the conic section.

4. The method of claim 2, wherein the reference axis for the reference curve extends substantially perpendicular to a directrix of the conic section.

5. The method of claim 2, wherein the conic section is selected from the group consisting of an ellipse, a parabola, and a hyperbola.

6. The method of claim 5, wherein the conic section is a parabola.

7. The method of claim 1, further comprising: forming a portion of an interior surface of the shell as a plurality of circumferential prisms.

8. The method of claim 7, wherein each of said circumferential prisms includes at least one circumferential wall that is displaced from an internal portion of the refractor.

9. The method of claim 8, wherein one circumferential wall is arranged substantially horizontally.

10. The method of claim 7, wherein at least one circumferential prism includes an inwardly-extending wall arranged parallel to an opening of the refractor.

11. The method of claim 1, further comprising: forming an exterior surface of the shell to generally conform to the surface of revolution, the exterior surface including a plurality of exterior prisms arranged substantially parallel to the plane curve.

12. The method of claim 11, wherein each of the exterior prisms includes a V-shaped groove extending substantially over the length of the plane curve.

13. The method of claim 12, wherein peaks of adjoining V-shaped grooves are formed at right angles.

14. The method of claim 12, wherein at least one of the V-shaped grooves has a width that changes over the length of the plane curve.

15. A refractor manufactured by the method of claim 1.

16. A method of manufacturing a refractor for a luminaire, the method comprising:

providing a reference parabola being rotatable with respect to a focus of the reference parabola;

creating an open-ended plane curve from the reference parabola, the plane curve having a plurality of segments corresponding to segments on the reference parabola that have been incrementally rotated with respect to the focus of the reference parabola; and forming a shell of a refractor by patterning the general shape of the shell as a surface of revolution of said plane curve about a rotational axis.

17. The method of claim 16, further comprising:

forming portion of an interior surface of the shell to include a plurality of circumferential prisms, each circumferential prism having an inwardly-extending wall arranged substantially parallel to an opening of the refractor and a circumferential wall that is displaced from an internal portion of the refractor.

18. The method of claim 16, further comprising:

forming an exterior surface of the shell to generally conform to the surface of revolution, the exterior surface including a plurality of exterior prisms arranged substantially parallel to the plane curve, each of the exterior prisms including a V-shaped groove extending substantially over the length of the plane curve, at least one of the V-shaped grooves having a width that changes over the length of the plane curve.

19. The method of claim 18, wherein peaks of adjoining V-shaped grooves are formed at right angles bisected by a radial line extending from the rotational axis.

20. A retractor manufactured by the method of claim 16.

21. A method of manufacturing a luminaire, the method comprising;

providing a lamp;

supporting the lamp with a socket;

forming a refractor that controls the distribution of light from the lamp, wherein the refractor is formed by:

providing a reference curve having a reference axis, the reference curve being rotatable with respect to a reference point on the reference axis;

creating a plane curve from the reference curve, the plane curve having a plurality of segments corresponding to segments on the reference curve that have been incrementally rotated with respect to the reference point on the reference axis; and forming a shell of a refractor by patterning the general shape of the shell as a surface of revolution of the plane curve about a rotational axis; and providing a support for the socket and retractor.

22. A luminaire manufactured by the method of claim 21.

23. The method of claim 21, further comprising:

forming a portion of an interior surface of the shell to include a plurality of circumferential prisms, each circumferential prism having an inwardly-extending wall arranged substantially parallel to an opening of the refractor and a circumferential wall that is displaced from an internal portion of the refractor.

24. The method of claim 21, further comprising:

forming an exterior surface of the shell to generally conform to the surface of revolution, the exterior surface including a plurality of exterior prisms arranged substantially parallel to the plane curve, each of the exterior prisms including a V-shaped groove extending substantially over the length of the plane curve, at least one of the V-shaped grooves having a width that changes over the length of the plane curve.

25.The method of claim 24, wherein peaks of adjoining V-shaped grooves are formed as right angles bisected by a radial line extending from the rotational axis.

* * * * *